US008272458B2

(12) United States Patent
Nackerud

(10) Patent No.: US 8,272,458 B2
(45) Date of Patent: Sep. 25, 2012

(54) DRILL BIT WITH REPLACEABLE BLADE MEMBERS

(76) Inventor: Alan L. Nackerud, Littleton, CO (US)

( * ) Notice: Subject to any disclaimer, the term of this patent is extended or adjusted under 35 U.S.C. 154(b) by 273 days.

(21) Appl. No.: 12/456,234

(22) Filed: Jun. 11, 2009

(65) Prior Publication Data

US 2009/0308664 A1 Dec. 17, 2009

Related U.S. Application Data

(60) Provisional application No. 61/131,758, filed on Jun. 12, 2008.

(51) Int. Cl.
*E21B 10/42* (2006.01)
*E21B 10/627* (2006.01)

(52) U.S. Cl. ..... 175/416; 175/412

(58) Field of Classification Search ..... 175/382, 175/383, 386, 412, 413, 240.1, 428, 419, 175/420, 420.1
See application file for complete search history.

(56) References Cited

U.S. PATENT DOCUMENTS

| | | | | |
|---|---|---|---|---|
| 1,808,159 | A * | 6/1931 | Cone | 175/412 |
| 2,498,251 | A | 2/1950 | Creel | |
| 2,783,973 | A | 3/1957 | Hawthorne | |
| 2,978,049 | A | 4/1961 | Skidmore | |
| 3,339,648 | A | 9/1967 | Blanton | |
| 4,289,210 | A | 9/1981 | Schoeffler | |
| 4,499,958 | A | 2/1985 | Radtke | |
| 4,838,366 | A | 6/1989 | Jones | |
| 5,361,859 | A | 11/1994 | Tibbitts | |
| 5,560,440 | A | 10/1996 | Tibbitts | |
| 6,454,024 | B1 | 9/2002 | Nackerud | |
| 2007/0251732 | A1 * | 11/2007 | Mirchandani et al. | 175/393 |

* cited by examiner

*Primary Examiner* — Brad Harcourt

(57) ABSTRACT

A drill bit for rotary drilling a well bore of a subterranean formation which has replaceable blades which overlap and interlock with each other and have retention means on more than one axis. The replaceable blades may have cutters with enhanced retention by brazing ring grooves and the body may be flared at its bottom to better retain the blades and cutters.

15 Claims, 10 Drawing Sheets

DRILL BIT WITH REPLACEABLE BLADE MEMBERS

CROSS-REFERENCE TO RELATED APPLICATIONS

This application claims the benefit of provisional patent application Ser. No. 61/131,758 filed Jun. 12, 2008 by Alan L. Nackerud, which is incorporated by reference herein.

BACKGROUND AND FIELD OF INVENTION

This invention generally relates to drill bits, specifically to those with replaceable blade members.

Previous drill bits with replaceable blade members have had poor cutting structure near the center of the drill bit. They have also been attached or affixed to the body of the drill bit but not sufficiently interlocked with the other replaceable blade members.

Most conventional PDC (Polycrystalline Diamond Cutter) or other hardened material fixed cutter drill bits are machined or forged with fixed integral body protruding blades having cutters inserted with a negative or back rake. This allows manufacturers to machine the pockets. The problem presented and which causes the manufacturers to make the drill bits with the negative rake is that the cutter pockets require a small oversize tolerance (e.g. 0.002 inch) for effective brazing and therefore must be machined with a rotating tool which requires a negative rake angle to clear the protruding preceding blade and/or the bottom of the bit. This problem increases as you move towards the center of the bit. This problem is overcome with insertable blades, which can overlap and interlock with each other. The cutter pockets can be machined and cutters placed in the blades prior to the blades being inserted into the body of the bit. This allows the advantage of any cutter rake (i.e. neutral, positive or negative) relative to the bottom of the bit and any cutter angle relative to the bit body center to achieve optimal cutting action.

Representative patents are U.S. Pat. No. 2,498,251 to Ernest S. Creel, U.S. Pat. No. 2,783,973 to Earl M. Weaver, U.S. Pat. No. 2,978,049 to Skidmore et al, U.S. Pat. No. 3,339,648 to Roscoe J. Blanton, U.S. Pat. No. 4,289,210 to William H. Schoeffler, U.S. Pat. No. 4,499,958 to Robert P. Radtke, Wilford V. Morris, U.S. Pat. No. 4,838,366 to A. Raymond Jones, U.S. Pat. No. 5,361,859 to Gordon A. Tibbitts, U.S. Pat. No. 5,560,440 to Gordon A. Tibbitts, U.S. Pat. No. 6,454,024 to Alan L. Nackerud.

SUMMARY OF THE INVENTION

It is an object of this invention to provide for a novel and improved drill bit which is highly versatile and efficient and durable in use.

Another object of the present invention is to provide for novel and improved blades which when paired together overlap each other to provide better cutting structure coverage especially near the center of the drill bit.

A further object of the present invention is to provide for novel and improved replaceable blades which when paired and pinned together provide for greater strength.

A further object of the present invention is to provide for novel and improved replaceable blades where each pair of blades are interlocked with the additional set of paired blades to provide greater strength.

A further object of the present invention is to provide for a novel and improved placement of multiple attachment pins between the blades and body that align with the drill bit body in more than one direction for added strength.

A further object of the present invention is to provide for novel and improved replaceable blades, which due to their overlapping positions can be more easily machined or forged to provide cutting elements with a neutral, positive or negative cutting rake especially at the center of the drill bit.

A further object of the present invention is to provide for novel and improved replaceable blades which have wedges that can be driven or placed between the blades and the bit body to provide better securing and tightening of the blades to the bit body.

There has been outlined, rather broadly, the more important features of the invention in order that the present contribution to the art my be better appreciated. There are of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in art will appreciate that the conception, upon which this disclosure is based, may readily be utilized as a basis for the designing of other structures, methods and systems for carrying out the several purposes of the present invention. It is important, therefore, that the claims be regarded as including such equivalent obstructions insofar as they do not depart from the spirit and scope of the present invention

DRAWINGS—FIGURES

DRAWINGS—REFERENCE NUMERALS

Figure 1:
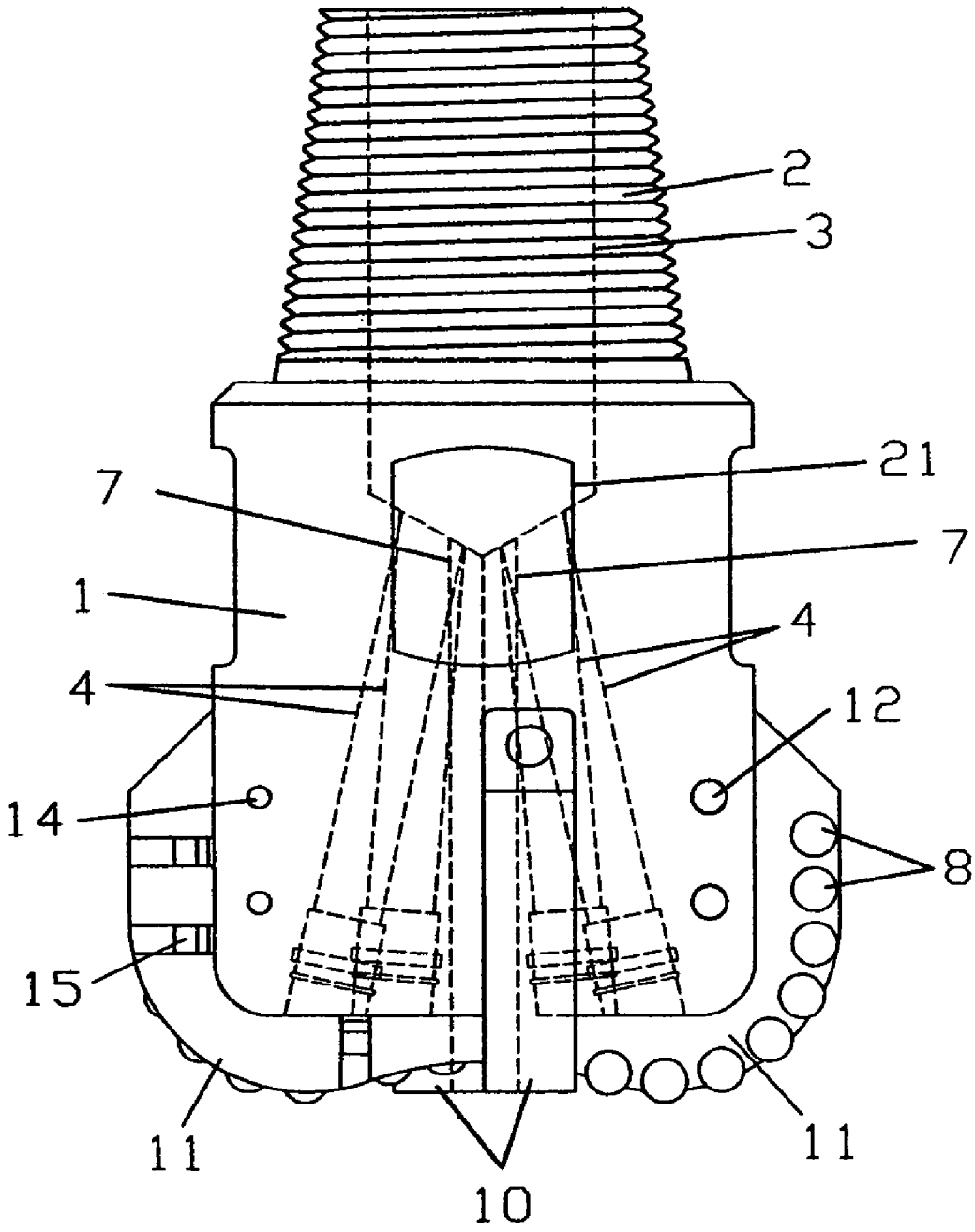
FIG. 1 is a side view of drill bit with fluid bores (first and third forms)
Figure 2:
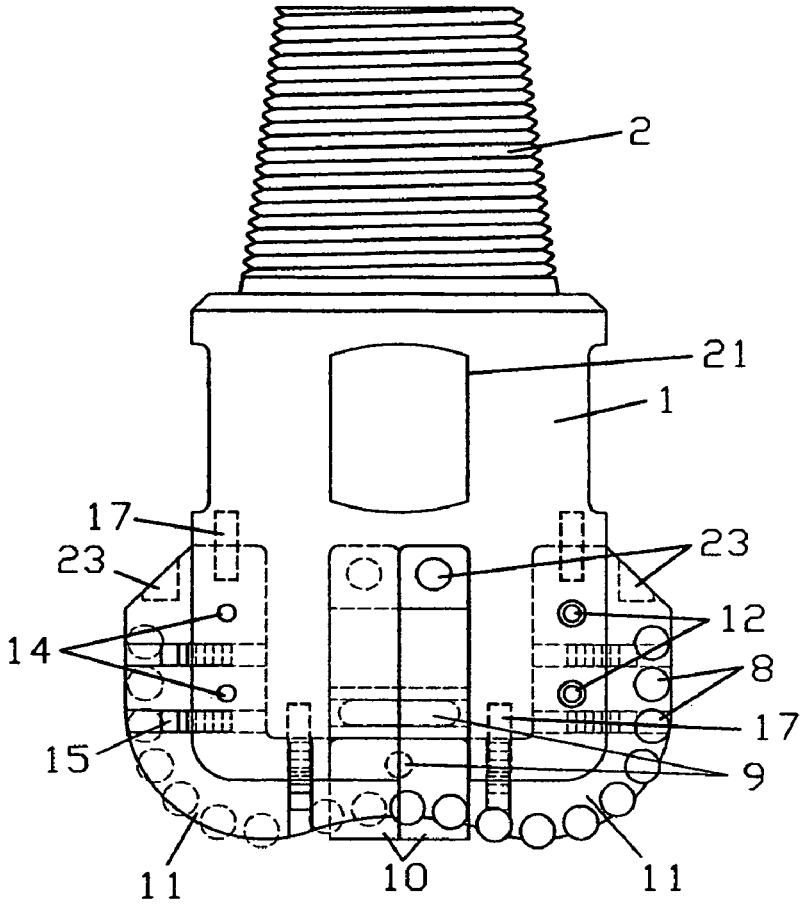
FIG. 2 is a side view of drill bit without fluid bores (first and third forms)
Figure 3:
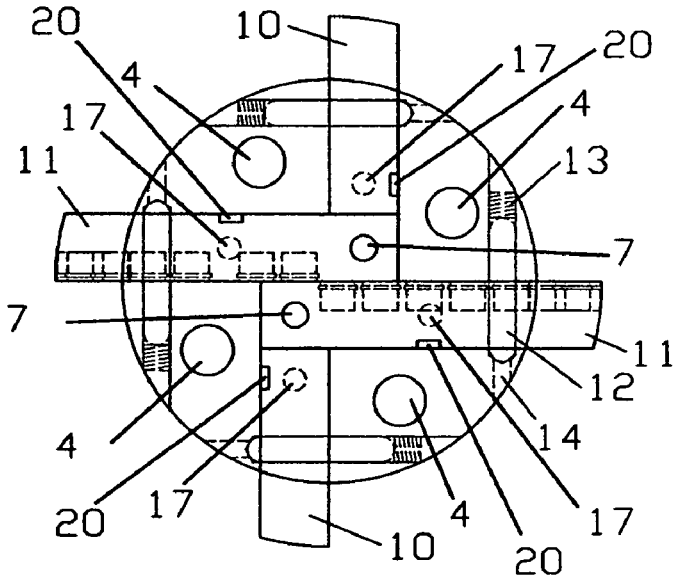
FIG. 3 is a bottom view of drill bit (first and third forms)

1. body
2. threaded connection
3. main fluid bore
4. angle bores
5. pockets
6. slots
7. additional fluid bores
8. cutters
9. retention pins
10. first set of blades
11. second set of blades
12. side pins
13. setscrews
14. small bores
15. small wedges
16. ring groove
17. secondary retention pins
18. braze material
19. flared bottom
20. wedge slots
21. flat
22. secondary retention pin holes
23. blade knock out holes
24. weld

DETAILED DESCRIPTION—FORMS FIRST, SECOND, THIRD, AND FOURTH

Figure 4:
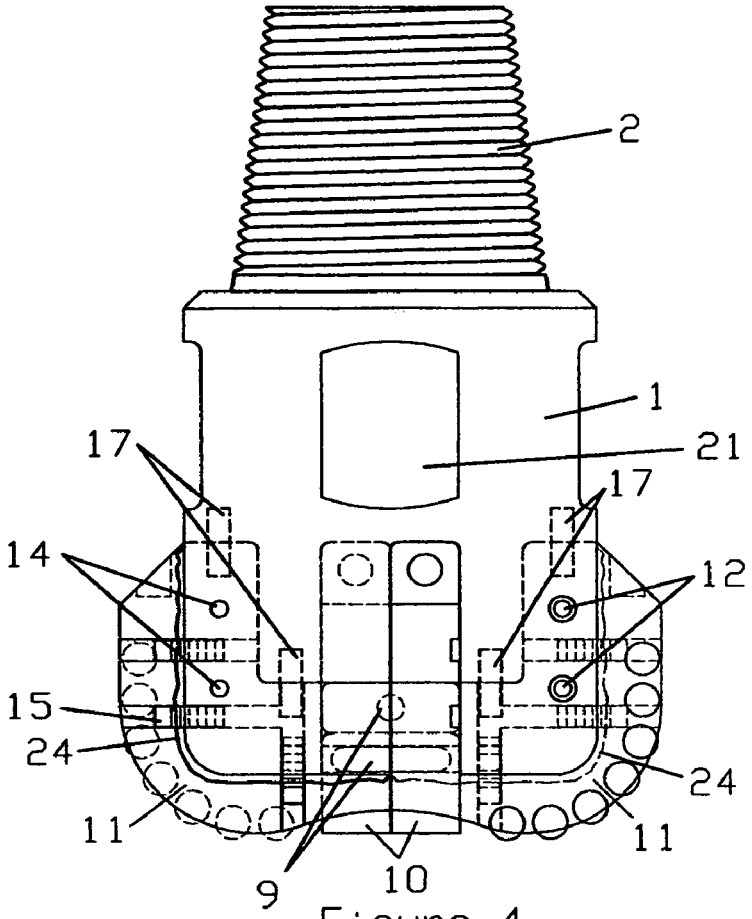
FIG. 4 is a side view of drill bit rotated 90 degrees with weld (second and third forms)
Figure 5:
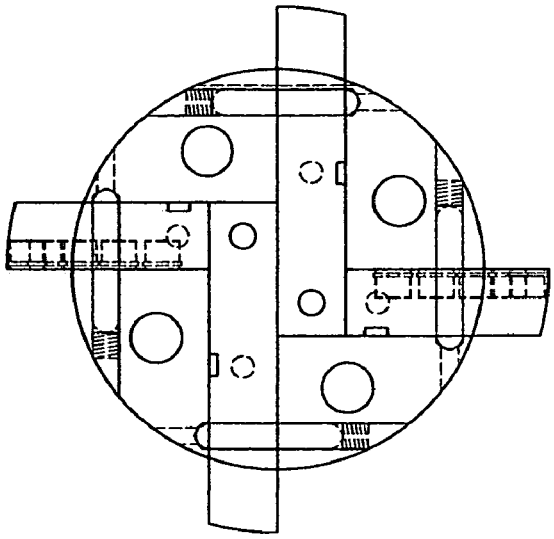
FIG. 5 is a bottom view of drill bit rotated 90 degrees (first and third forms)
Figure 6:
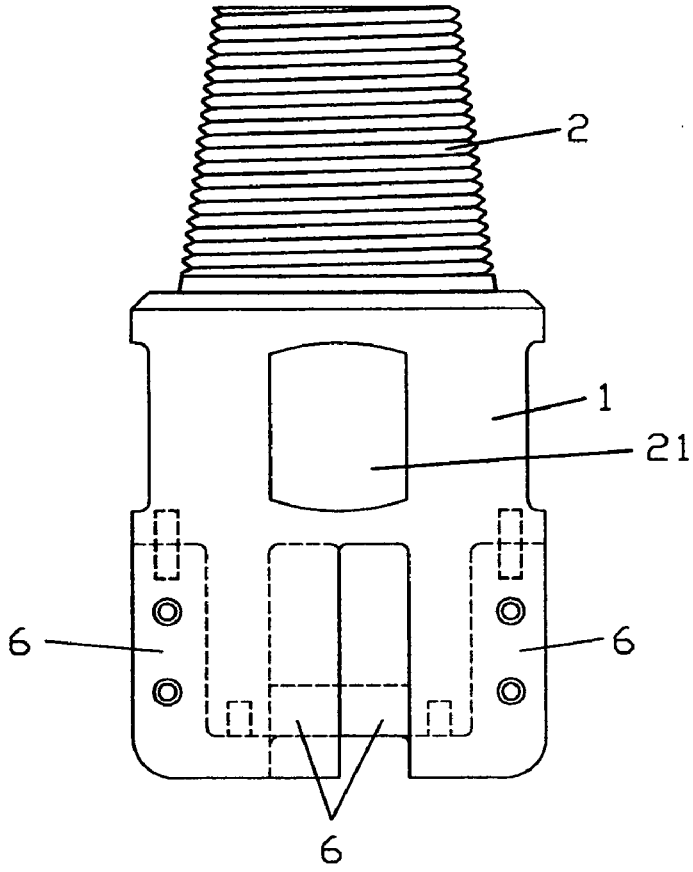
FIG. 6 is a side view of drill bit with blade slots and no blades (first, second, and third forms)
Figure 7:
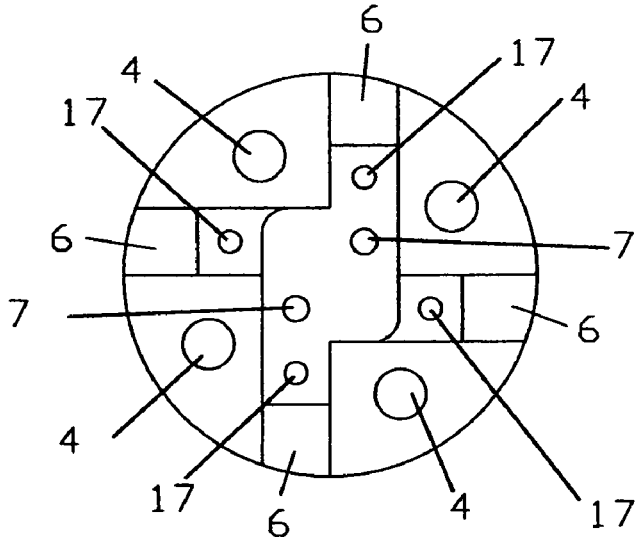
FIG. 7 is a bottom view of drill bit with blade slots and no blades (first, second, and third forms)
Figure 8:
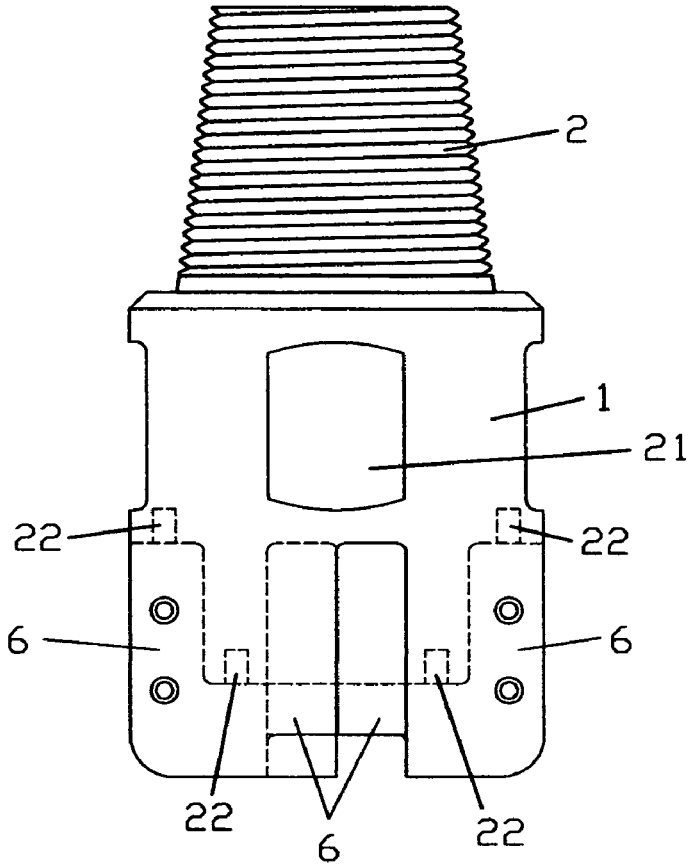
FIG. 8 is a side view of drill bit with blade slots and no blades rotated 90 degrees (first, second, and third forms)
Figure 9:
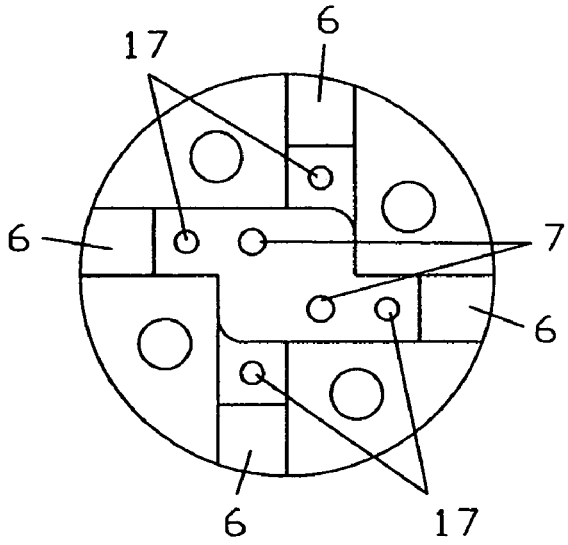
FIG. 9 is a bottom view of drill bit with blade slots and no blades rotated 90 degrees (first, second, and third forms)
Figure 10:
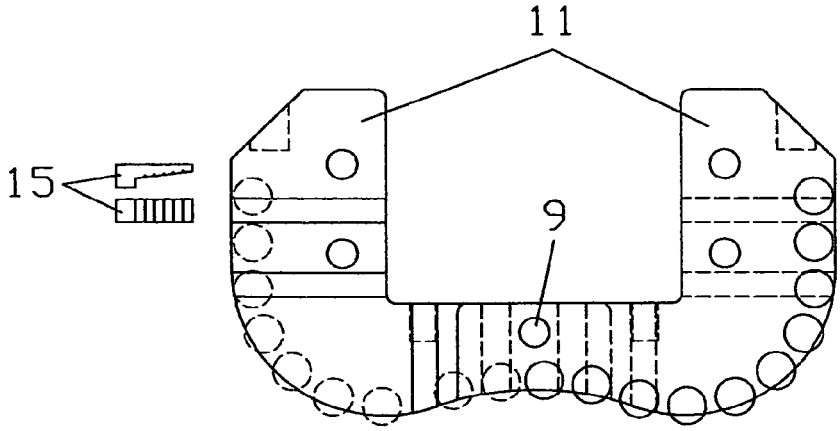
FIG. 10 is a side view of second set of blades pinned together (first, second, third, and fourth forms)
Figure 11:
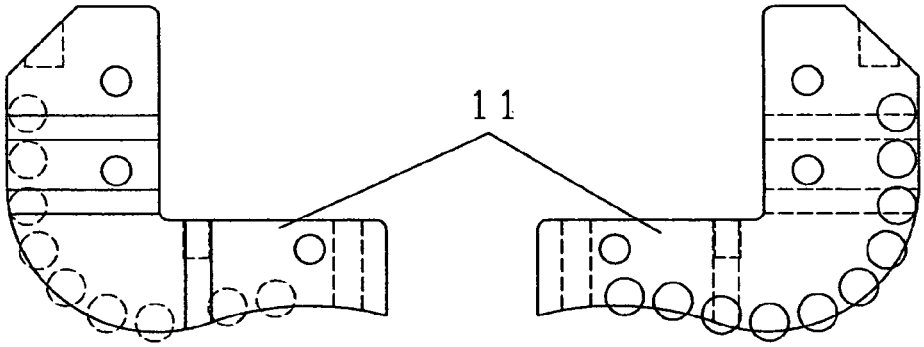
FIG. 11 is a side view of second set of blades separated (first, second, third, and fourth forms)
Figure 12:
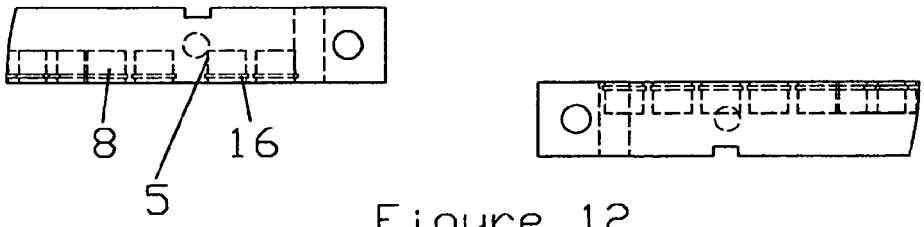
FIG. 12 is a bottom view of second set of blades separated (first, second, third, and fourth forms)
Figure 13:
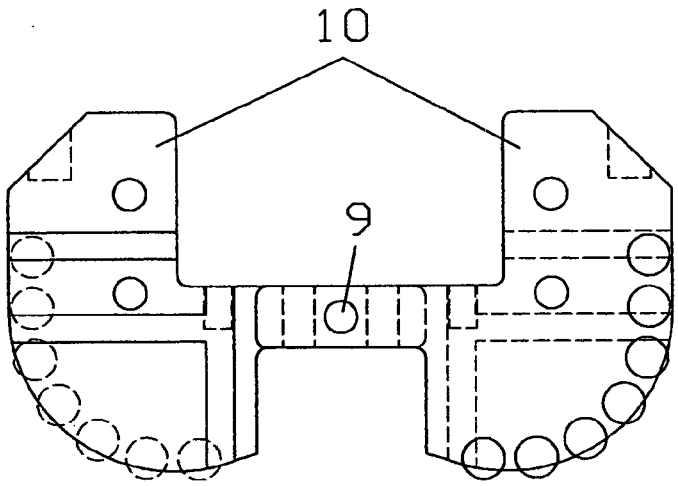
FIG. 13 is a side view of first set of blades pinned together (first, second, third, and fourth forms)
Figure 14:
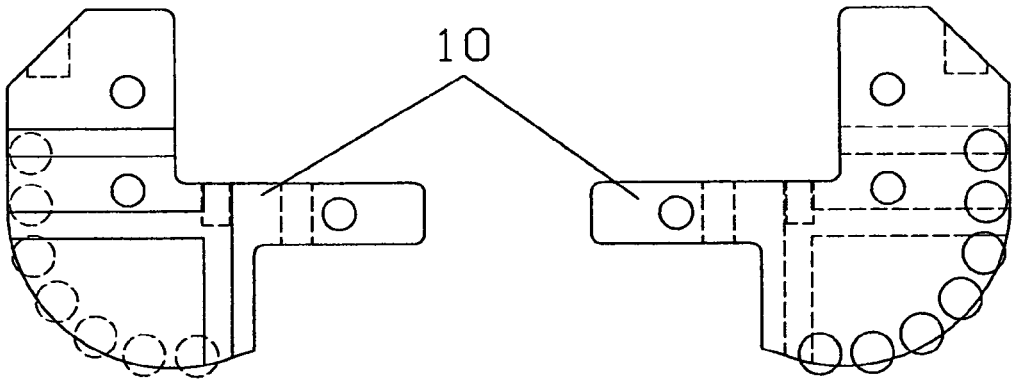
FIG. 14 is a side view of first set of blades separated (first, second, third, and fourth forms)
Figure 15:
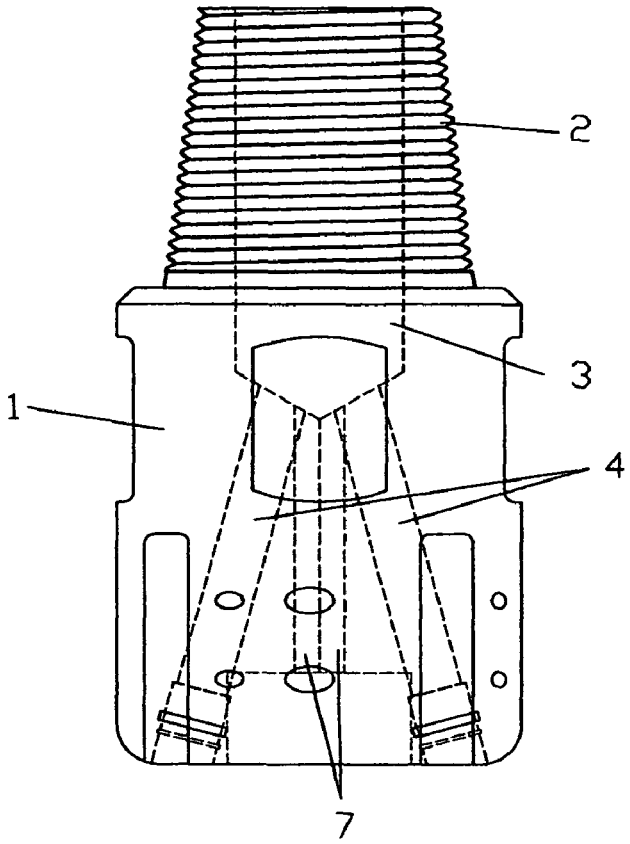
FIG. 15 is a side view of drill bit body with fluid bores (first, second, and third forms)
Figure 16:
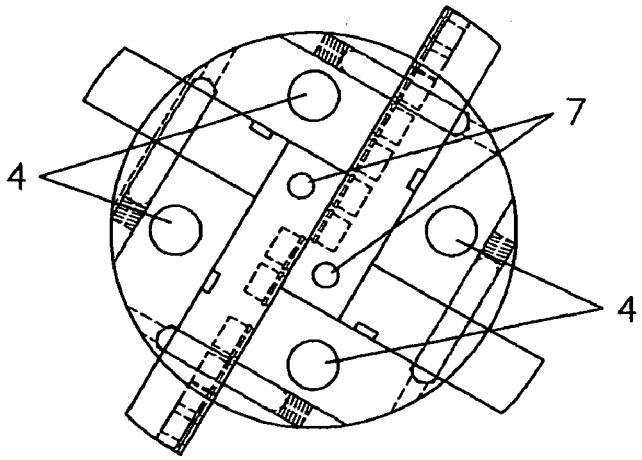
FIG. 16 is a bottom view of drill bit with fluid bores (first and third forms)
Figure 17:
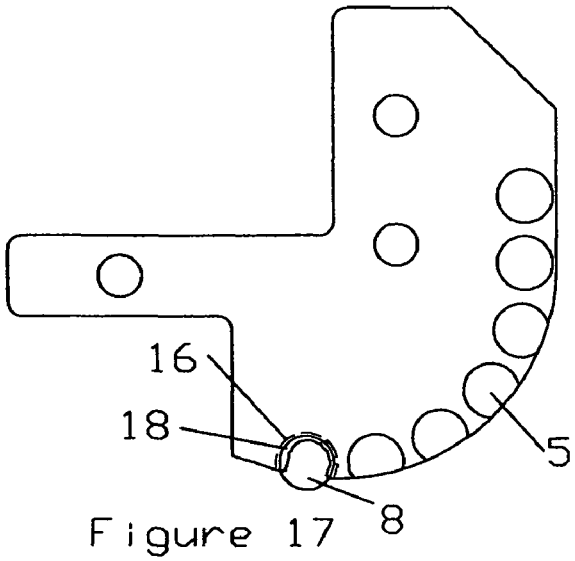
FIG. 17 is a side view of blade with pocket, cutter and braze material (first, second, third, and fourth forms)
Figure 18:
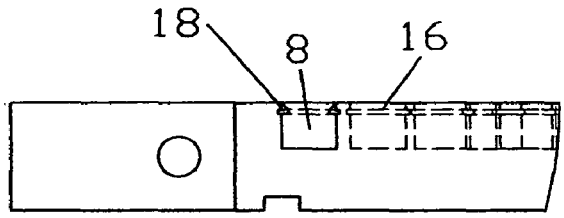
FIG. 18 is a bottom view of blade with pocket, cutter and braze material (first, second, third, and fourth forms)
Figure 19:
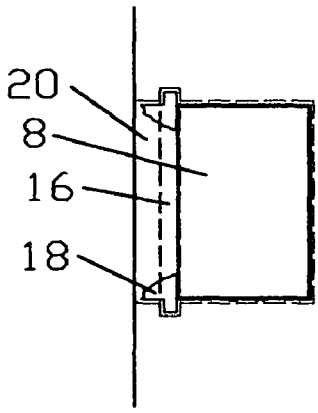
FIG. 19 is an enlarged side view of cutter in pocket of blade with braze material (first, second, third, and fourth forms)

Referring to the drawings, there is illustrated in FIGS. 1 through 20 four forms of the drill bit assembly. In FIG. 1 (First Form of Drill Bit) the body 1 of the drill bit has a threaded connection 2 on top to allow connection to a drill string. One or more flats 21 are located near the top of the drill bit body 1 to assist in holding the drill bit as it is screwed or unscrewed to the drill string. A main fluid bore 3 runs through the pin connection 2 and into the body 1 where it meets with additional angle bores 4, and optional additional fluid bores 7 which run out through the bottom of the body 1 to provide fluid circulation to remove cuttings and cool the tool. FIG. 1 (First Form of Drill Bit) shows one embodiment of the drill bit with blades 10, 11 affixed to the body 1 by retention pins 9, side pins 12, secondary retention pins 17, and small wedges 15. FIG. 4 (Second Form of Drill Bit) shows another embodiment with blades affixed by any combination of retention pins 9, side pins 12, secondary retention pins 17, small wedges 15 and weld 24 of the blades to the body.

The drill bit body 1 is slotted at 6 to receive one or more replaceable blades 10, 11 (four blades in the drawings). The blades 10, 11 are tipped with PDC (Polycrystalline Diamond Compact) cutters 8 or other hardened material to cut the bore. The blades 10, 11 in the drawing are paired and overlapping and held together and aligned with pins 9. The first pair of blades 10 to be inserted in the body is slotted so that the second pair of blades 11 when inserted will fit against and be perpendicular to the first pair of blades 10. Secondary retention pins 17 are placed in between the blades 10, 11 and bit body 1 to further align and hold the blades 10, 11 to the bit body 1. Optional secondary fluid bores 7 connect from the main fluid bore 3 and downward through the bit body 1 and blades 10, 11 to cool the tool and assist cuttings removal near the center of the tool. The blades 10, 11 are inserted into the bit body slots 6 from the bottom and pinned with side pins 12 to the body. The side pins 12 stay in place with drill string clockwise rotation. The side pins 12 can be further retained in place by setscrews 13, weld or other means. After drill bit use and the blades have become worn, the side pins 12 can be knocked out by way of the small bore 14 on the backside. The blades 10, 11 can then be removed from the body and redressed or replaced. Should additional blade retention strength be needed the blades 10, 11 can be welded to the body as represented at 24 with or without pins 12, 9, 17 as shown in FIG. 4. Another option for blades 10, 11 retention is the use of small tapered wedges 15 driven in between the backside of blades 10, 11 and body 1 to tighten the fit in the slots 6 especially in tools being reused. After drill bit use the blades can be removed by removing all pins and welds and then tapping downward on the lower ends of blade knock-out holes 23 located near the top of each blade 10, 11.

The cutters 8 in blades 10, 11 can be brazed into the pockets 20. Additional retention methods may be used, such as those described in conjunction with the first and second forms above. As shown in FIGS. 12, 17, 18 and 19 (Third Form of the Drill Bit) the cutters 8 can have enhanced brazed retention by cutting a ring groove 16 in each cutter pocket 20 just above the top of the cutters 8. When the brazing material 18 is heated it runs into the void between the cutters 8 and pockets 20 and also fills the ring groove 16. When it fills the ring groove 16 it pools (overlaps) onto the cutter 8 top enhancing retention similar to a snap ring retention device. This is especially beneficial with PDC cutters 8 due to the fact that the diamond does not bond well to brazing material.

Figure 20:
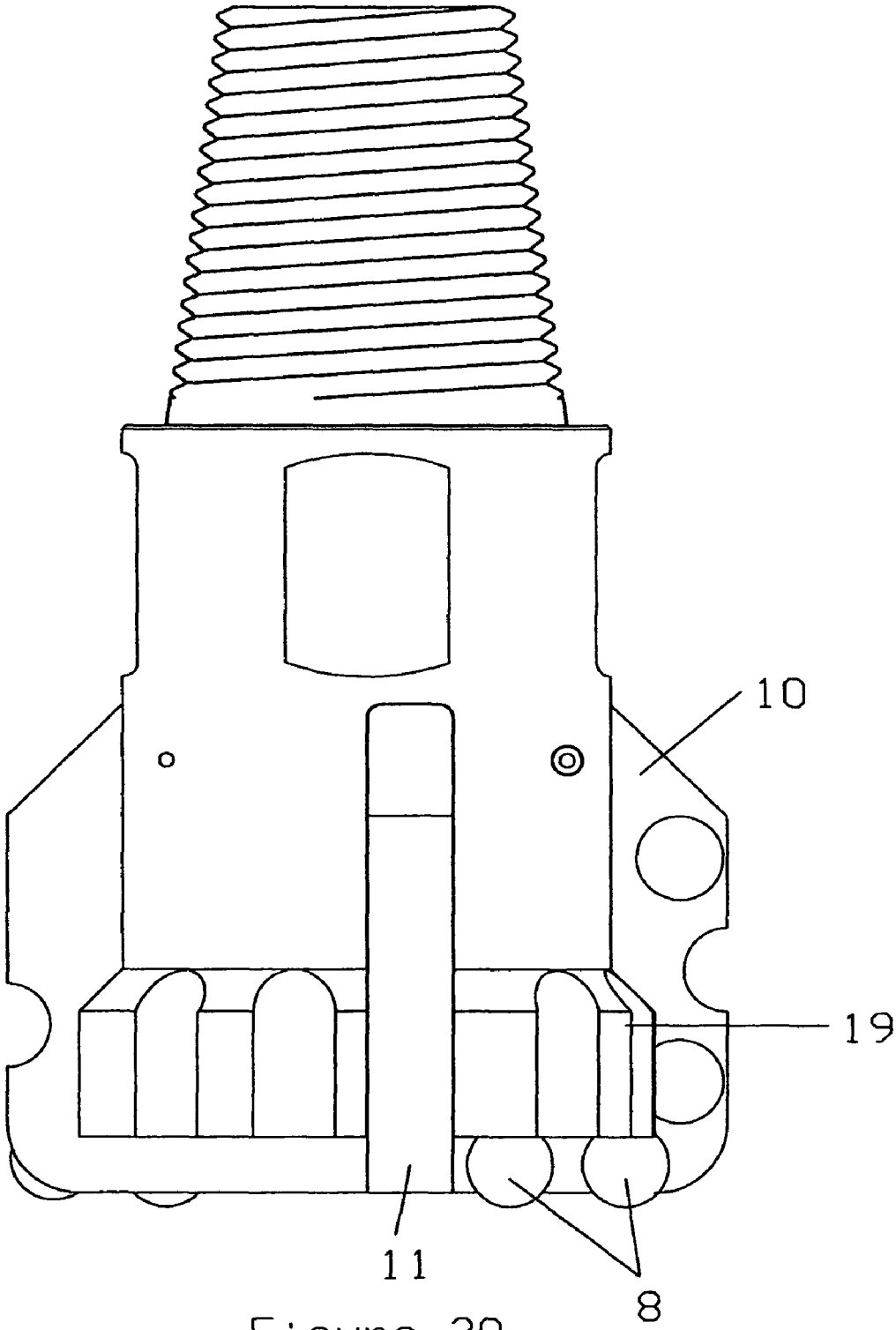
FIG. 20 is a side view of modified embodiment with flared bottom (fourth form).

In FIG. 20 (Fourth Form of Drill Bit) the body of the drill bit is flared out at the bottom. The flared bottom 19 would provide additional retention of the cutters 8 and blades 10, 11 as it overlaps the cutters 8 and blades 10, 11. This flaring also allows additional brazing between the body and blades and cutters to further add strength to cutter 8 retention. After drill bit use, the brazing can be reheated and melted whereupon the blades 10, 11 can be removed for redress or replacement. If the blades 10, 11 have been welded to the body the weld can be ground off and the blades 10, 11 removed for redress or replacement. The flared portion of the body and the blades 10, 11 can be notched to allow enhanced fluid and cuttings removal.

Additional blades may be added as part of the drill bit. They could be insertable blades or integral blades being machined or forged as part of the body. (Many conventional PDC bits have more than four blades.) The bit can have all insertable blades or a combination of insertable and integral fixed blades. In horizontal drilling more than four blades would be useful to keep the bit centralized.

It is therefore to be understood that even though numerous characteristics and advantages of the present embodiments have been set forth in the foregoing description, together with the details of the structure and function of the embodiments, the disclosure is illustrative only, and changes may be made within the principles of the embodiments to the full extent indicated by the broad general meaning of the terms in which the appended claims are expressed and reasonable equivalents thereof, and other modifications may be made therein without departing from the spirit and scope of the invention as defined by the appended claims and reasonable equivalents thereof.

I claim:

1. A drill bit, comprising a body with at least one substantially radially oriented slot opening onto the exterior thereof wherein at least one pair of replaceable cutter blades in an overlapping position to each other are inserted into said one or more slots and affixed to said body by one or more pins or other means wherein the overlapping blades are connected to each other by a pin or other means whereby the overlapping blades are aligned to each other and attached to each other for additional strength wherein a second pair of cutter blades in an overlapping position to each other are placed over said first pair of cutter blades in a position perpendicular to and interlocking said first pair of cutter blades and affixed to said body by one or more pins or other means.

2. In a drill bit according to claim 1 wherein said cutter blades are affixed to said body by one or more pins or other means located axially to said body through said cutter blades and said body, and also one or more pins or other means located parallel to said body through part of said blades and part of said body whereby each said blade is attached to said body in more than one axis.

3. In a drill bit according to claim 2 wherein numerous cutters or other cutting element means are positioned on the leading edge around the periphery including and covering the center of the drill bit axis whereby the full leading edge of the drill bit is covered.

4. In a drill bit according to claim 3 wherein said cutters or other cutting element means are inserted in cutter pockets and retained by braze material or other means in grooves machined or forged in said cutter pockets wherein the braze material or other cutter retention means are located inside said grooves and overlapping said cutting elements whereby better retention is achieved.

5. In a drill bit according to claim 4 wherein said cutter blades are retained in position and secured by wedges placed in slot(s) on said cutter blades.

6. In a drill bit according to claim 5 wherein said body is flared at the bottom which partially covers said cutting elements providing better retention of same.

7. In a drill bit according to claim 6 wherein said cutters or other cutting element means on one pair of blades are positioned in a different radial position than those of the perpendicular pair of blades thereto whereby complete coverage of the cutting face of the drill bit is achieved.

8. A drill bit, comprising a body with at least one substantially radially oriented slot opening onto the exterior thereof wherein at least one pair of replaceable cutter blades in an overlapping position to each other are inserted into said one or more slots and affixed to said body by one or more pins or other means and where said cutter blades are affixed to said body by one or more pins or other means located axially to said body through said cutter blades and said body and also one or more pins or other means located parallel to said body through part of said blades and part of said body whereby each said blade is attached to said body in more than one axis wherein the overlapping blades are connected to each other by a pin or other means whereby the overlapping blades are aligned to each other and attached to each other for additional strength wherein numerous cutters or other cutting element means are positioned on the leading edge around the periphery including and covering the center of the drill bit axis whereby the full leading edge of the drill bit is covered wherein said cutters or other cutting element means are inserted in cutter pockets and retained by braze material or other means in grooves machined or forged in said cutter pockets wherein the braze material or other cutter retention means are located inside said grooves and overlapping said cutting elements whereby better retention is achieved.

9. In a drill bit according to claim 8 wherein said cutter blades are retained in position and secured by wedges placed in slot(s) on said cutter blades.

10. In a drill bit according to claim 9 wherein said body is flared at the bottom which partially covers said cutting elements providing better retention of same.

11. In a drill bit according to claim 10 wherein said cutters or other cutting element means on one blade are positioned in a different radial position than those of the overlapping blade whereby complete coverage of the cutting face of the drill bit is achieved.

12. A drill bit, comprising a body with at least one substantially radially oriented slot opening onto the exterior thereof wherein at least one pair of replaceable cutter blades in an overlapping position to each other are inserted into said one or more slots and affixed to said body by one or more pins or other means and where a second pair of cutter blades in an overlapping position to each other are placed over said first pair of cutter blades in a position perpendicular to and interlocking said first pair of cutter blades and affixed to said body by one or more pins or other means.

13. In a drill bit according to claim 12 wherein said cutter blades are retained in position and secured by wedges placed in slot(s) on said cutter blades.

14. In a drill bit according to claim 13 wherein numerous cutters or other cutting element means are inserted in cutter pockets and retained by braze material or other means in grooves machined or forged in said cutter pockets wherein the braze material or other cutter retention means are located inside said grooves and overlapping said cutting elements whereby better retention is achieved.

15. In a drill bit according to claim 14 wherein said cutters or other cutting element means on one blade are positioned in a different radial position than those of the overlapping blade whereby complete coverage of the cutting face of the drill bit is achieved.

* * * * *